US007054456B2

(12) United States Patent
Smits et al.

(10) Patent No.: US 7,054,456 B2
(45) Date of Patent: May 30, 2006

(54) INVERTEDLY DRIVEN ELECTROSTATIC SPEAKER

(75) Inventors: Maarten Smits, Ede (NL); Hidde W. de Haan, Ede (NL)

(73) Assignee: Final Sound International Pte. Ltd., Singapore (SG)

( * ) Notice: Subject to any disclaimer, the term of this patent is extended or adjusted under 35 U.S.C. 154(b) by 207 days.

(21) Appl. No.: 10/853,043

(22) Filed: May 25, 2004

(65) Prior Publication Data

US 2005/0147265 A1 Jul. 7, 2005

Related U.S. Application Data

(60) Provisional application No. 60/534,542, filed on Jan. 6, 2004.

(51) Int. Cl.
*H04R 25/00* (2006.01)

(52) U.S. Cl. ..... 381/191; 381/116; 381/176

(58) Field of Classification Search ..... 381/111, 381/116, 173–176, 191, 399; 367/170, 181
See application file for complete search history.

(56) References Cited

U.S. PATENT DOCUMENTS

| | | | |
|---|---|---|---|
| 4,323,736 | A | 4/1982 | Strickland |
| 5,392,358 | A | 2/1995 | Driver |
| 5,471,540 | A | 11/1995 | Maeda |
| 5,748,758 | A | 5/1998 | Menasco, Jr. et al. |
| 6,188,772 | B1 | 2/2001 | Norris et al. |
| 2002/0141606 | A1 | 10/2002 | Schweder et al. |

*Primary Examiner*—Suhan Ni
(74) *Attorney, Agent, or Firm*—Larson & Larson, PA; Herbert W. Larson

(57) ABSTRACT

An electrostatic speaker system is provided wherein a multitude of speakers are provided in the system, each speaker having a thin electrically conductive film membrane sandwiched between a pair of stator plates. The film membrane is directly coupled to a high voltage AC audio signal emanating from a power amplifier for reproducing an audio signal. The high voltage AC audio signal is not applied to the stator plates but instead indirectly coupled to the pair of stators by a plurality of condensers (in a voltage multiplier circuit) of a electrical circuit contained within each speaker of the system. By applying the high voltage AC audio signal to the film membrane, approximately one-quarter of the voltage typically used to drive an electrostatic speaker is required.

20 Claims, 6 Drawing Sheets

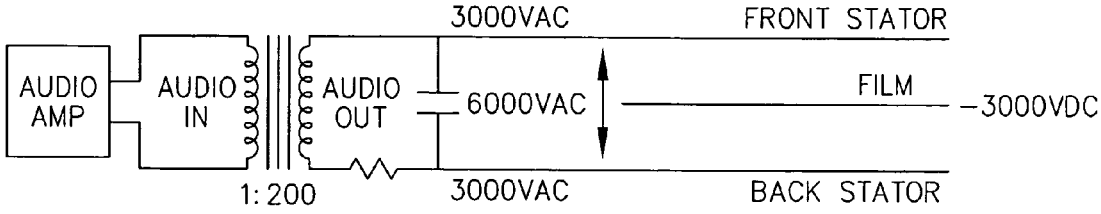
FIG. 1A PRIOR ART
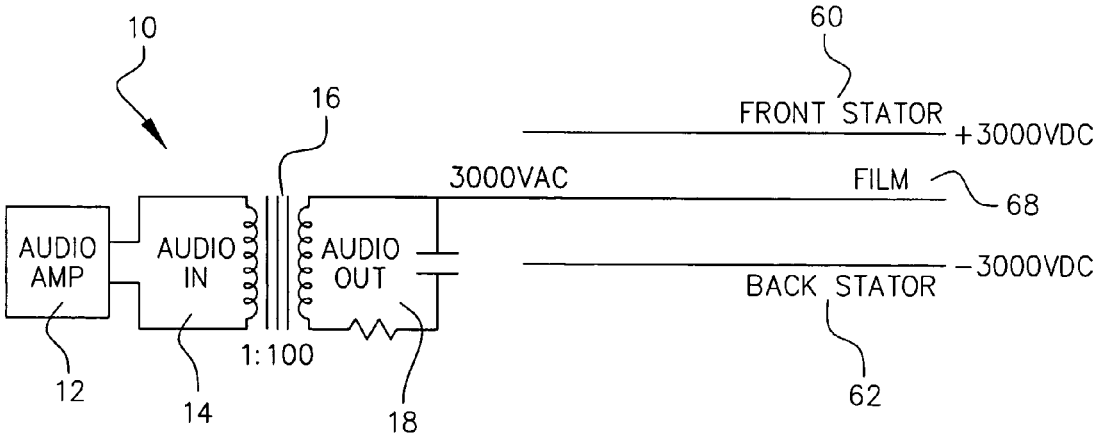
FIG. 1B INVERTED

INVERTEDLY DRIVEN ELECTROSTATIC SPEAKER

This application claims the benefit of U.S. Provisional Application No.: 60/534,542 filing date Jan. 6, 2004.

BACKGROUND OF THE INVENTION

1. Field of the Invention

The present invention relates to electrostatic speakers. More particularly, it relates to an electrostatic speaker invertedly driven with respect to traditional electrostatic speakers such that a high voltage AC audio signal is applied to the diaphragm and a static DC charge is applied to the stators.

2. Description of the Prior Art

Electrostatic speakers utilize complex electrostatic circuitry to reproduce audio signals. Known electrostatic speakers reproduce sound by allowing a thin flexible diaphragm, having an electrical conductive surface applied thereto, to move between two fixed plates (front and rear), also known as the stators. Each stator is made to have the same area as the diaphragm.

Prior art electrostatic speaker systems require a high voltage power supply to feed the diaphragm (also known as the membrane) with a permanent and unchanging (static) electrical charge typically between 5000 and 6000 volts. This differs substantially from cone driven speakers, which move back and forth in response to an audio signal applied to the speaker through a coil; no power supply is needed to drive a cone type speaker system since no electrical charge is applied to the cone driver.

In known electrostatic speaker technology, the audio signal transmitted by an audio amplifier to the speaker is converted by an audio power transformer into a high voltage AC audio signal and applied to the two stators (the two fixed plates). As a result, the stators produce alternately positive and negative electrical fields causing the diaphragm to vibrate back and forth, due to like and repelling charges between the static (unchanging) electrical charge placed on the diaphragm (by the bias power supply) and the high voltage AC audio signal placed on the front and back stators (by the audio amplifier). The vibrating diaphragm reproduces the sound of the audio signal emanating from the audio amplifier, which is connected to an audio reproduction device, such as CD player.

The high voltage AC audio signal applied to the stators of prior art electrostatic speaker systems can be dangerous if touched or punctured. So much so, that Applicant is unaware of any known electrostatic speaker system that has received a UL (Underwriters Laboratories®) safety standard listing, which requires that high voltages not be present in electronic devices, which can easily shock or electrocute users of the c device. The use of high voltage AC audio signals on prior art electrostatic speaker systems has been a hindrance to the manufacturers of these known electrostatic speaker systems and has prohibited them from receiving UL® approval. Simply put, electrical shock to a user is possible in prior art electrostatic speakers and needs to be avoided. Since it is difficult to isolate the stators from being touched, the problem of potential electrical shock in prior art electrostatic speakers still exists today and needs to be addressed and eliminated if possible.

Prior art electrostatic speaker systems also require exotic, stable and very powerful, and more often than not, very expensive amplifiers (preferably tube amplifiers) to drive them and to perform well as designed. This need stems from the very low impedance requirements (values) of the speaker at very high frequencies, resulting in heavy loads being applied to the audio amplifier driving the electrostatic speaker. Reduction in power requirements for an improved electrostatic speaker system would permit less expensive and less sophisticated amplifiers to be employed permitting more users (consumers) to enjoy the unique audio reproduction experience of electrostatic speaker systems. The need for less exotic audio amplifiers also opens the door for the use of electrostatic speakers in environments other than those in which they are currently employed (i.e., home theaters).

Prior art electrostatic speakers are also known to lack wide disbursement of the sound field they reproduce. In particular, the mid and high frequencies are not very well spread in all directions due to being bundled on the speaker panel. This is known as lacking in "directivity" or having a very narrow and short beam radiation. This equates to forming a very small, critical, ideal listening location for the listening environment (also known as the "sweet spot"). Of course, this problem is not so critical with cone driver speaker systems, wherein the diffraction of the sound waves (the audio signal) is very wide. It would be highly advantageous to provide an electrostatic speaker system that provides better disbursement of the audio signal, which is closer to that seen with cone driven speaker systems. Some inventions have improved slightly on the disbursement problem wherein curved stators are used to provide for better sound disbursement or where a delaying of the radiation of the outer places of the speaker panel is accomplished by employing resistors (so called "Quad Electrostatic Speakers"). However, this has added complexity and cost to known electrostatic speaker technology.

Clearly, an improved electrostatic speaker system is needed which overcomes the deficiencies seen in the prior art. An improved electrostatic speaker system is needed, which could avoid the application of high voltage AC signals to the stators. Such an improved electrostatic speaker would then eliminate, almost entirely, the chance of electrical shock to a user who may inadvertently touch or puncture a stator. Further, by eliminating the application of the high voltage AC signal to the stators, a more common, and therefore less expensive, audio amplifier could be employed. Further, improvements are also needed in the disbursement of the sound waves of the audio signal emanating from electrostatic speakers such that a greater range of frequencies are disbursed in a wider angle so that critical hot spots are no longer required when listening to an audio source reproduced by an electrostatic speaker.

SUMMARY OF THE INVENTION

We have invented an improved electrostatic speaker system which overcomes the major deficiencies seen in prior art electrostatic speakers. Our electrostatic speakers do not require that a high voltage AC audio signal be applied to the stators. Accordingly, the chance of electrical shock by touching the stator is essentially eliminated.

Our electrostatic speakers operate by an inversion principle, wherein the high voltage AC audio signal is applied to the diaphragm instead of the stators, hence an invertedly driven electrostatic speaker. Condensers (voltage multipliers) are used to couple the audio voltage to the stator plates and to rectify a static DC voltage for application to the stators.

In the preferred embodiment, a pair of (front and back) stator plates are used and a thin sheet of electrically conductive film (the diaphragm) is disposed there between. The diaphragm has a high resistive value and is coupled to a high voltage audio power transformer in an audio signal electrical circuit. Low impedances are avoided for the speaker and a more desirable 4 ohm load can be run on the invertedly driven electrostatic speaker system of the present invention. Traditional 1 ohm loads, used on prior art electrostatic speaker systems, are avoided.

The diaphragm of our invertedly driven electrostatic speaker system is acoustically filtered, wherein low pass filtering is applied to one side of the film separating the high and mid frequencies thereby avoiding a beaming radiating panel and providing a wider and longer disbursement of the sound waves emanating from each speaker panel.

Most importantly, even though a high voltage AC audio signal is being applied to the diaphragm and not the stators directly, approximately one-quarter of the typically applied amount of audio high voltage is needed using our novel invertedly driven electrostatic speaker system. This allows for a more simple and less expensive audio amplifier to be used to drive our speakers as compared to the power needs for driving prior art electrostatic speakers. This translates into a safer electrostatic speaker system, which is more efficient than any speaker the prior art, all the while providing a speaker having a greater frequency response.

BRIEF DESCRIPTION OF THE DRAWINGS

The invention may be best understood by those having ordinary skill in the art by reference to the following detailed description when considered in conjunction with the accompanying drawings in which:

FIG. 1A is a schematic diagram of an electrical circuit employed in a prior art electrostatic speaker system;

FIG. 1B is a schematic diagram of an electrical circuit employed in the preferred embodiment of an invertedly driven electrostatic speaker of the present invention;

DETAILED DESCRIPTION OF THE INVENTION

Referring to FIG. 1B, a novel electrical circuit 10 employed in an invertedly driven electrostatic speaker of the present invention is shown. An audio amplifier 12 provides an audio signal to be reproduced by a pair of invertedly driven electrostatic speakers of the present invention. Although not shown, it is understood that audio amplifier 12 is coupled to a audio player device, such as, for example, a CD player. The audio signal from audio amplifier 12 is applied at audio in 14 to a step-up transformer 16 since the audio signal outputted from audio amplifier 12 is at a signal level, which is insufficient to be reproduced by the speakers. In the preferred embodiment, a step-up transformer having a turn ratio of 1:100 is employed for producing a high voltage AC audio signal at audio out 18. This high voltage AC audio signal is applied to a thin film membrane (to be discussed in further detail herein below) of an electrostatic speaker of the present invention representing an inverted application of the audio signal as compared to prior art electrostatic speakers. In the preferred embodiment, and as shown in FIG. 1B, a 3000 VAC audio signal is employed. However, voltages in the range of 2000–6000 volts could be used.

Figure 3:
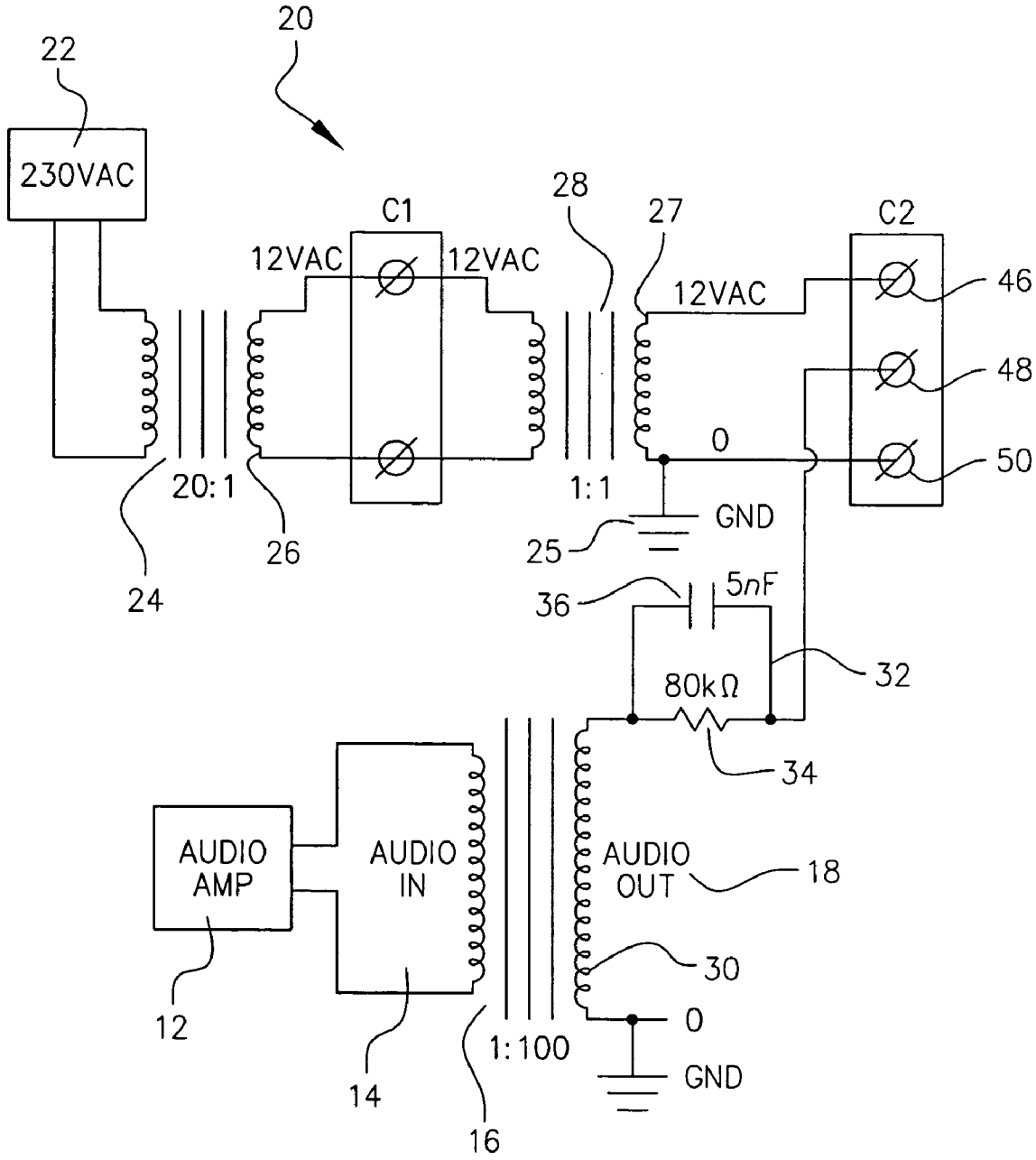
FIG. 3 is an electrical schematic diagram of an audio input circuit employed in the invertedly driven electrostatic speaker system of the present invention.
Figure 4:
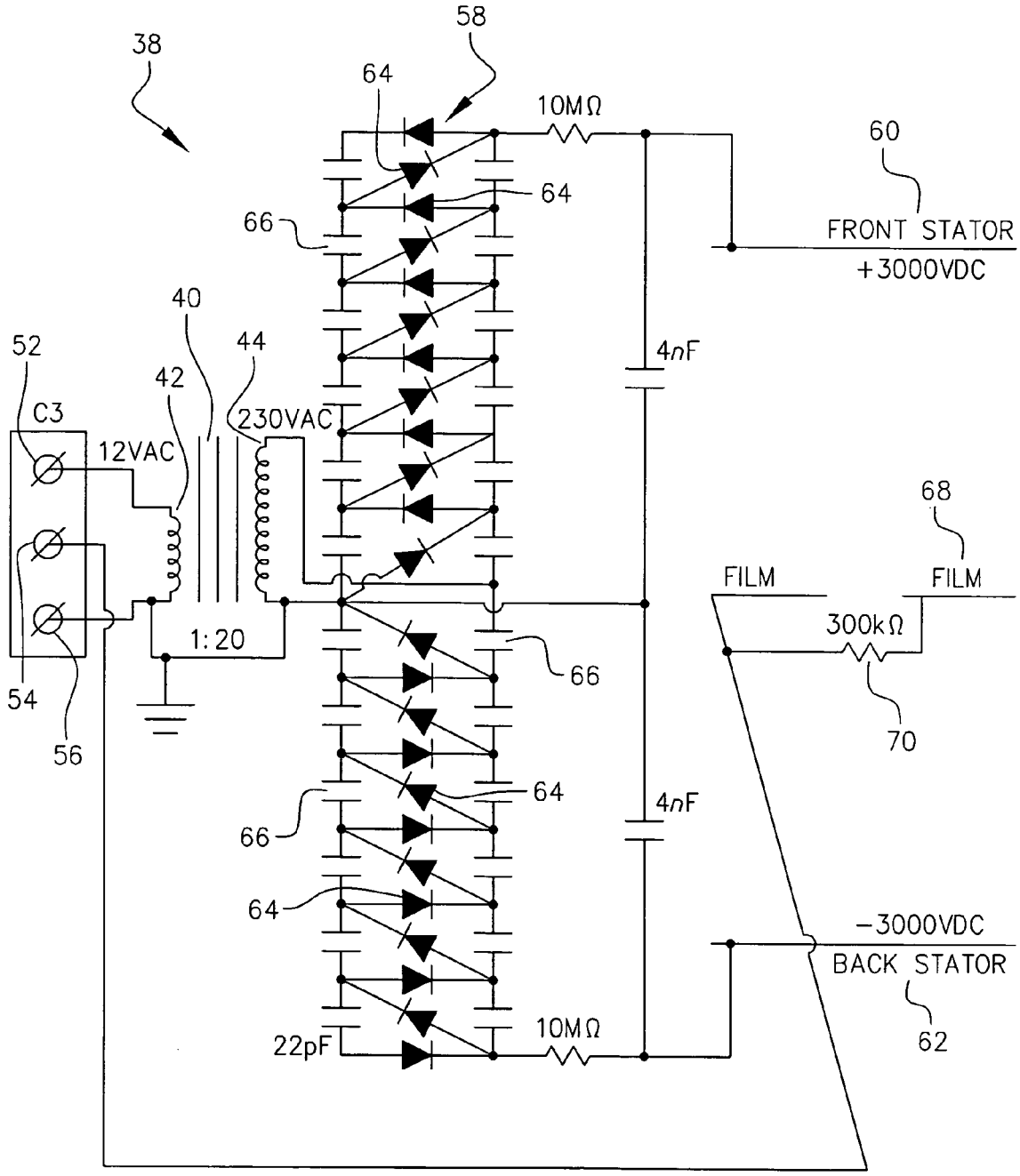
FIG. 4 is an electrical schematic diagram of circuitry employed with the invertedly driven electrostatic speaker system of the present invention illustrating how a high voltage AC audio signal is applied to a diaphragm, sandwiched between a pair of stator plates, of our novel electrostatic speaker.

Referring to FIGS. 3 and 4, a more detailed schematic diagram of electrical circuit 10 (as shown in FIG. 1B) of the present invention is shown. FIG. 3 illustrates an audio input circuit 20 used in the present invention. As shown, audio input circuit 20 receives power from an AC voltage source 22. In this illustration, it is shown that a 230 VAC source is employed (the standard used throughout most of Europe and other parts of the world). However, nothing herein limits the use of a 110 VAC source, as used in the United States, or any other voltage source, in the invertedly driven electrostatic speakers of the present invention. AC voltage source 22 is applied to a step-down transformer 24. In the preferred embodiment, transformer 24 has a 20:1 turn ratio for stepping AC voltage source 22 down to a 12 VAC signal at the secondary 26 of transformer 24. In a 110 VAC system, a 10:1 step-down transformer would be utilized providing the same 12 VAC signal at secondary 26 of transformer 24. The 12 VAC signal is then directed through an isolation transformer 28 for precluding shock potentials since there is no ground in a 230 VAC source (2 hot wires and no ground). In a 110 VAC system, isolation transformer 28 could be removed since a ground is present in a 110 VAC voltage source at the source (1 hot wire and ground). As shown in FIG. 3, a ground potential 25 is employed at a secondary 27 of isolation transformer 28.

With continuing reference to FIG. 3, audio amp 12 provides an audio signal to be reproduced by the speakers. The audio signal from audio amplifier 12 is applied at audio in 14 to step-up transformer 16 since the audio signal outputted from audio amplifier 12 is at a signal level, which is insufficient for use by the speakers; an audio signal having a much higher amplitude is needed. Transformer 16 has a turn ratio of 1:100 in the preferred embodiment representing a power reduction by a factor of 2 as compared to the prior art. A high voltage AC audio signal is produced at a secondary 30 of transformer 16 at audio out 18. A band pass filter 32 is provided at secondary 30 of step-up transformer 16 and includes a resistor 34 and a capacitor 36.

Referring to FIG. 4, an electrical inversion circuit 38 of electrical circuit 10 (see FIG. 1B) of the present invention is shown. In the preferred embodiment, inversion circuit 38 is coupled to audio input circuit 20 by connectors C2 and C3, as shown in FIGS. 3 and 4, respectively. However, nothing herein limits audio input circuit 20 and inversion circuit 38 from being directly coupled (hard-wired) without the use of connectors C2 and C3. In the preferred embodiment, the 12 VAC voltage source is applied to a first jumper 46 of connector C2, ground (0 V) is applied to a third jumper 50 of connector C2 and the high voltage AC audio signal from audio out 18 is applied to a second jumper 48 of connector C2.

As shown in FIG. 4, connector C3 provides the stepped-down 12 VAC voltage source at a first jumper 52 of connector C3, the ground (0V) at a third jumper 56 of connector C3 and the high voltage AC audio signal at a second jumper 54 of connector C3. The 12 VAC voltage source is applied to a step-up transformer 40 at a primary 42 of transformer 40. In the preferred embodiment, transformer 40 has a turn ratio of 1:20 for increasing the 12 VAC voltage source to 230 VAC at a secondary 44 of transformer 40. Jumper 56 of connector C3 couples ground to respective second ends of primary 42 and secondary 44 of step-up transformer 40. The 230 VAC source voltage is then applied to a polarized voltage multiplier circuit 58 (also known as a condenser) boosting the voltage level and rectifying the AC voltage source to a DC voltage. In a 60 Hz 110 VAC system (as used in the US), circuit 58 will also suppress any ripple effect inherent 60 HZ 110 VAC systems. In the preferred embodiment, the AC voltage source is rectified to a static +3000 VDC and −3000 VDC providing a 6000 volt potential, which is applied to a front stator 60 and a back stator 62, respectively, of the electrostatic speaker of the present invention. Nothing herein limits the use of other DC voltage levels, such as those in the range of 2000–6000 VDC. These static electrical charges, applied to stators 60 and 62, are not dangerous to the touch. A pair of large resistors (10 M ohms each) are coupled at both ends of voltage multiplier circuit 58 to avoid shock to a user who may inadvertently touch one of the stator plates, 60 and 62, in the event that any of the high voltage AC audio signal bleeds directly onto stator plates 60 and 62. Voltage multiplier 58 utilizes a multitude of diodes 64 to boost the voltage source. In the preferred embodiment, a dozen positive diodes 64 and a dozen negative diodes 64 are employed in voltage multiplier circuit 58. Each pair of diodes doubles the voltage source. A plurality of capacitors 66 are also employed in voltage multiplier circuit 58 for preventing the voltage from dropping back down after being boosted by diodes 64 by holding the charge.

With continuing reference to FIG. 4, the high voltage AC audio signal at second jumper 54 of connector C3 is applied directly to a film 68 (also known as the diaphragm) sandwiched between front and back stators, 60 and 62, respectively. This illustrates the inverted signal principle used in the novel electrostatic speakers of the present invention. Since film 68 is connected directly to the high voltage AC audio signal supplied by audio step-up transformer 16, low impedances are avoided. This reduces load capabilities for the audio amplifier (i.e., a 4–9 ohm load instead of a 1 ohm load). This translates into a reduction in impedance by a factor of 4.

As further shown in FIG. 4, film 68 also contains low pass filtering 70 located on one of two sides of film 68 for prohibiting the speaker from being a beaming radiating panel and for providing a wider and longer sound wave disbursement (to be discussed in further detail herein after).

Figure 5:
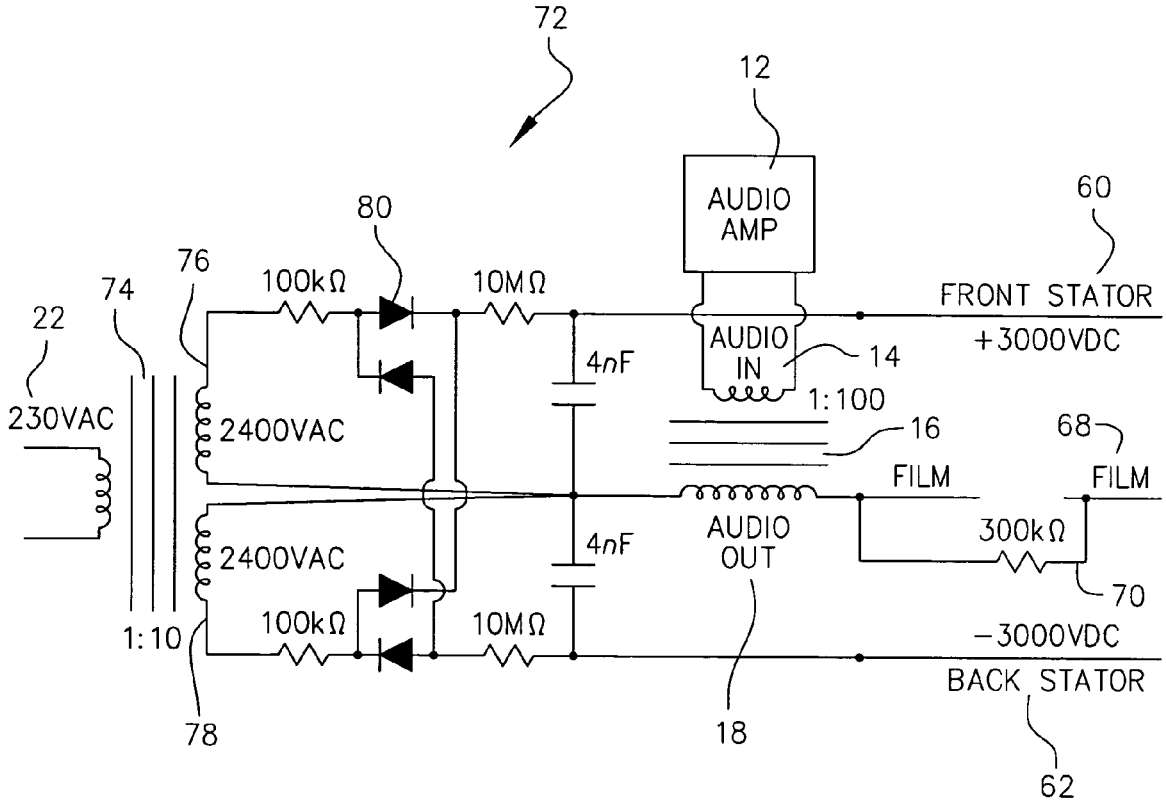
FIG. 5 is an electrical schematic diagram of circuitry employed with an alternate invertedly driven electrostatic speaker system of the present invention illustrating how a high voltage audio signal is applied to a thin sheet of film (the diaphragm) sandwiched between a pair of stator plates of my novel electrostatic speaker.

Referring to FIG. 5, an alternate embodiment of the present invention for an invertedly driven electrostatic speaker system is shown as circuit 72. Here again, the high voltage AC audio signal is applied directly to film 68 and not to front and back stators, 60 and 62, respectively. Low pass filtering 70 is also being employed across film 68 on one side thereof. In alternate circuit 72, however, a step-up transformer 74, having dual secondaries, 76 and 78, is being used to boost the 230 VAC voltage source to about 2400 VAC. A bridge rectifier 80 is coupled to opposed ends of secondaries 76 and 78, rectifying the voltage source to a DC voltage of 3000 VDC. Since dual secondaries, 76 and 78, are employed, a 6000 VDC potential is created such that a static +3000 VDC can be applied to front stator 60 and a static −3000 VDC can be applied to back stator 62. In this alternate circuit 72, voltage source transformer 74 has a turn ratio of 1:10 and audio source transformer 16 has a turn ratio of 1:100. Alternate circuit 72 is a power amplifier circuit and replaces the power amplifier and transformer as employed in the preferred embodiment of FIGS. 3 and 4. This power amplifier circuit also supplies the DC voltage for the stators.

Figures 2A, 2B:
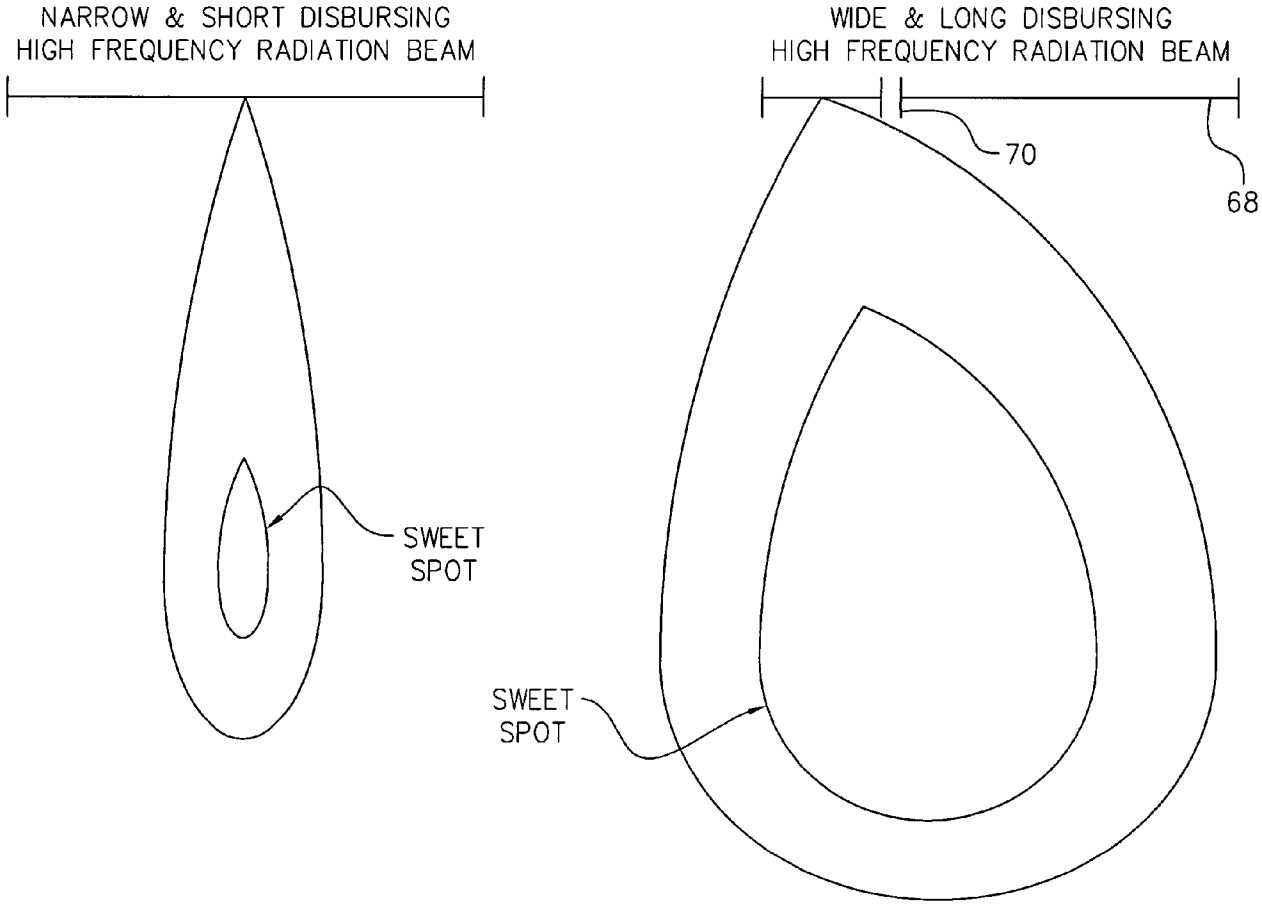
FIG. 2A PRIOR ART
FIG. 2A is an illustration of a narrow sound wave disbursement typically achieved with prior art electrostatic speakers.
FIG. 2B is an illustration of a wide sound wave disbursement realized with the invertedly driven electrostatic speaker system of the present invention.

Referring now back to FIGS. 2A and 2B, typical sound wave disbursement patterns of a prior art electrostatic speaker and that of an invertedly driven electrostatic speaker of the present invention are shown. FIG. 2A illustrates the inherent problem with prior art electrostatic speakers, wherein a narrow and short radiating beam for the sound wave projects from the speaker, especially in the high frequency range. This causes a very small "sweet spot" to be formed within the radiating beam where the speaker sounds optimal for the listener. Movement away from the sweet spot causes a noticeable drop in the high frequency range such that the quality of the audio decreases becoming unenjoyable. FIG. 2B illustrates the invertedly driven electrostatic speaker of the present invention. By providing low pass filtering 70 on film 68, a wider and longer radiating beam for the sound wave projecting from the speaker is provided as well as a film having a higher resistive value. This generates a much larger sweet spot, such that a listener can move about a room where the speaker is located and not notice any degradation in sound quality. Low pass filtering 70 separates the high and mid frequencies on the electrostatic speaker providing a more uni-directional disbursement of the sound wave.

Figure 6:
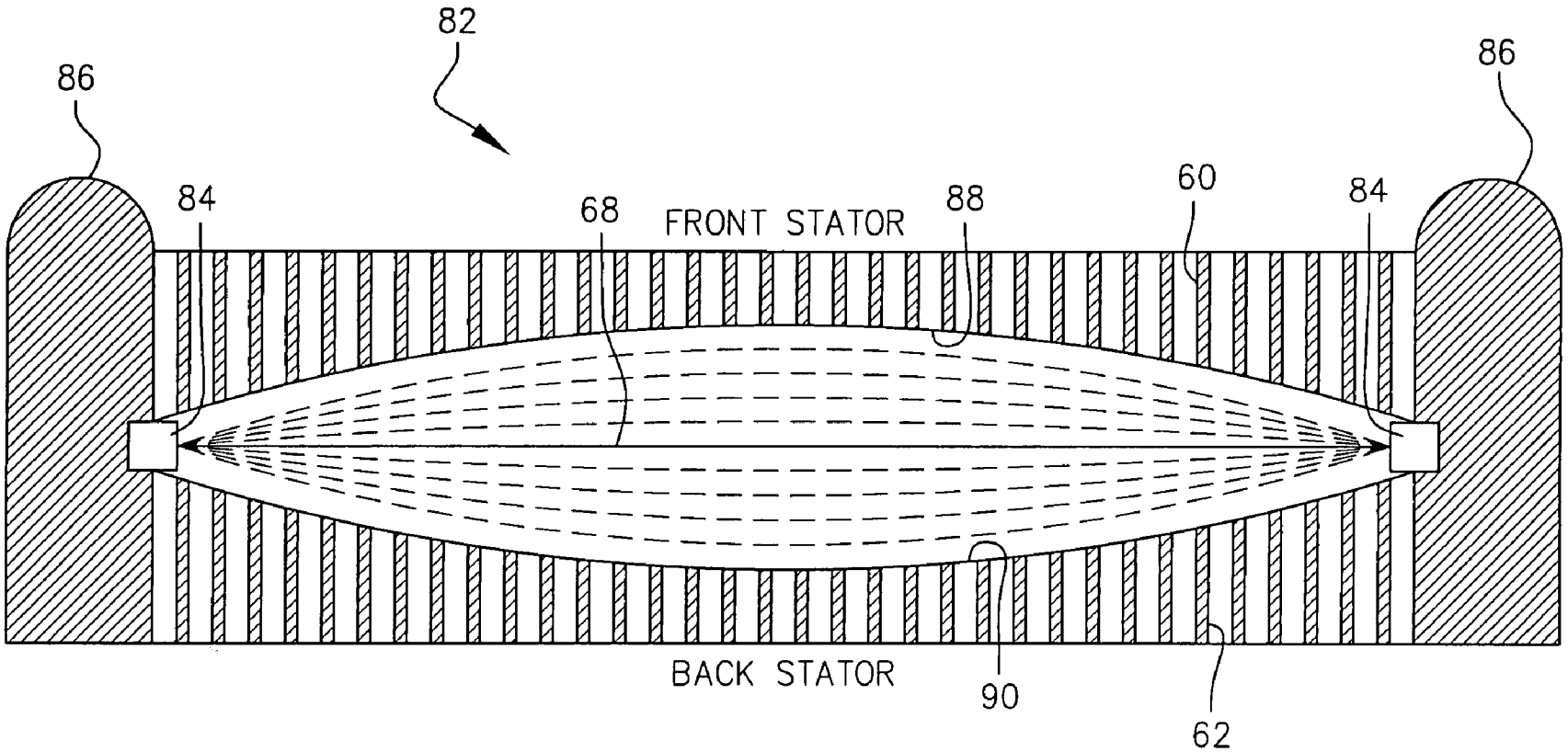
FIG. 6 is a cross-sectional view of an electrostatic speaker of the present invention illustrating how concave-shaped stators can be employed along inner surfaces of the stators proximal to the diaphragm.

Referring to FIG. 6, a cross-sectional view of an electrostatic speaker 82 from a top portion looking down is shown. Speaker 82 includes front and back stator, 60 and 62, respectively, film 68 positioned intermediate stators 60 and 62, spacers 84 positioned at opposed ends of film 68 for holding film 68 in place, and opposed side rails 86 for supporting stators 60 and 62 and spacers 84. Front and back stators 60 and 62 have concave-shaped inner surfaces, 88 and 90, respectively, proximal to film 68. Concave-shaped inner surfaces 88 and 90 of stators 60 and 62 permit film 68 to bow outward towards each stator, 60 and 62, thereby precluding film 68 from arcing by touching either stator 60 and 62.

Both the preferred embodiment of FIGS. 3 and 4 and the alternate embodiment of FIG. 5 can be employed in a modularly expandable electrostatic speaker system, like that seen in U.S. Pat. No. 6,459,799, and is incorporated herein by reference. Accordingly, the present invention can be utilized in a surround sound system having left and right front speakers, a center speaker and left and right rear speakers, for example. Use of an electrostatic speaker for the center speaker (positioned horizontally instead of vertically) is possible since the sound wave disbursement is improved through the use of low pass filtering 70. Further, a central unit, as seen in U.S. Pat. No. 6,459,799 can be employed for separately relaying power to each speaker from a single power source coupled to the central unit and the high voltage AC audio signal within a single speaker cable connected to each speaker (the power source and audio signal are transmitted by separate wires, shielded from one another, within the single speaker cable).

Equivalent elements can be substituted for the ones set forth above such that they perform the same function in the same way for achieving the same result.

The invention claimed is:

1. An improved electrostatic speaker system comprising:

a) at least one electrostatic speaker coupled to an AC voltage source and including a front and back stator plate positioned in a parallel relationship with respect to one another and having a multitude of bores formed in each stator;

b) an electrically conductive flexible film membrane positioned intermediately parallel to the front and back stator plates, the film membrane vibrating forward and backward between the front and back stator in response to a high voltage AC audio signal applied to the film membrane from an audio power transformer coupled to an audio amplifier providing an audio signal, the bores formed in the stators allowing air to pass through each stator when the film is vibrating; and c) the front and back stators receiving a static DC bias voltage rectified from the AC voltage source causing the film membrane to vibrate in response to opposite charges between the high voltage AC audio signal on the film membrane and the static DC bias voltage on the stators, reproducing the audio signal provided by the audio amplifier.

2. The improved electrostatic speaker system of claim 1, further comprising a voltage multiplier coupled between the voltage source and the stators for boosting and rectifying the AC voltage source to a static DC bias voltage for placement on the stator plates.

3. The improved electrostatic speaker system of claim 2, wherein the front stator receives a positive 3000 voltage DC and the back stator receives a negative 3000 volts DC.

4. The improved electrostatic speaker system of claim 1, further comprising low pass filtering coupled along the film member.

5. The improved electrostatic speaker system of claim 1, wherein the high voltage AC audio signal is 3000 volts AC.

6. The improved electrostatic speaker system of claim 1, further comprising an isolation transformer coupled between the AC voltage source and the stator plates.

7. The improved electrostatic speaker system of claim 1, wherein the electrostatic speaker system places a load on the audio amplifier between 4 and 9 ohms.

8. The improved electrostatic speaker system of claim 1, wherein the audio power transformer is coupled intermediate the audio amplifier and the film member.

9. The improved electrostatic speaker system of claim 8, wherein the audio power transformer has a turn ratio of 1:100.

10. The improved electrostatic speaker system of claim 1, wherein the at least one electrostatic speaker includes lefty and right front speakers, a center speaker and left and right rear speakers.

11. The improved electrostatic speaker system of claim 1, wherein each electrostatic speaker of the system receives a source voltage from a central unit coupled to the audio amplifier and a single source voltage, the central unit separately relaying a power source and the audio signal to each electrostatic speaker of the system.

12. The improved electrostatic speaker system of claim 11, wherein a power cable and an audio signal cable are both bundled within a single speaker cable for each electrostatic speaker coupled to the central unit, the bundled power and audio signal cables shielded from one another within the single speaker cable.

13. The improved electrostatic speaker system of claim 1, wherein the stators are made from non-metallic material.

14. An improved electrostatic speaker system including a plurality of electrostatic speaker panels, the improved system comprising:

a) each speaker panel coupled to a power source and including a front and back stator plate positioned parallel with respect to one another and having a multitude of bores formed therein;

b) an electrically conductive flexible film membrane positioned between the front and back stator plate of each speaker panel, the film membrane vibrating back and forth between each front and back stator responsive to a high voltage AC audio signal applied to the film membrane from an audio power transformer coupled to an audio amplifier providing an audio signal, the bores formed in the front and back stators allowing air to pass there through when the film is vibrating;

c) the front and back stator receiving a static DC bias voltage rectified from the power source causing the film membrane to vibrate responsive to opposite charges between the high voltage AC audio signal on the film membrane and the static DC bias voltage on the stators;

d) a voltage multiplier circuit coupled between the power source and the stators for boosting and rectifying an AC voltage source to a static DC bias voltage for placement upon the stator plates; and e) low pass filtering coupled along the film membrane of each speaker panel.

15. The improved electrostatic speaker system of claim 14, wherein the power source is an AC source voltage chosen from the group consisting of 230 VAC and 110 VAC.

16. The improved electrostatic speaker system of claim 14, further comprising the front and back stator each having a concave-shaped inner surface proximal to the film membrane.

17. The improved electrostatic speaker system of claim 14, wherein each electrostatic speaker panel of the system receives its power source from a central unit coupled to the audio amplifier and a single AC source voltage, the central unit separately relaying the power source and the audio signal to each electrostatic speaker of the system.

18. The improved electrostatic speaker system of claim 17, wherein a power cable and an audio signal cable are both bundled within a single speaker cable for each electrostatic speaker panel coupled to the central unit, the bundled power and audio signal cables shielded from one another within the single speaker cable.

19. The improved electrostatic speaker system of claim 14, wherein the stators are made from non-metallic material.

20. The improved electrostatic speaker system of claim 14, wherein the low pass filtering of the film membrane separates high and mid frequencies of a sound wave projected by each speaker panel.

* * * * *